US005913318A

United States Patent [19]

Gueret

[11] Patent Number: 5,913,318

[45] Date of Patent: Jun. 22, 1999

[54] PRODUCT APPLICATOR AND PACKAGING UNIT COMPRISING SUCH APPLICATOR

[75] Inventor: Jean-Louis H. Gueret, Paris, France

[73] Assignee: L'Oreal, Paris, France

[21] Appl. No.: 08/807,276

[22] Filed: Feb. 28, 1997

[30] Foreign Application Priority Data

Mar. 1, 1996 [FR] France ..... 96 02625

[51] Int. Cl.[6] ..... A45D 33/34

[52] U.S. Cl. ..... 132/293; 132/317; 132/320

[58] Field of Search ..... 132/317, 218, 132/293, 313, 318, 320; 15/244.1, 244.3, 244.4, 229.14, 114, 143.1

[56] References Cited

U.S. PATENT DOCUMENTS

| | | | |
|---|---|---|---|
| 1,690,274 | 11/1928 | Coryell . | |
| 1,752,765 | 4/1930 | Van Sant | 132/320 |
| 2,350,707 | 6/1944 | Vaughn . | |
| 2,399,997 | 7/1946 | Flaster . | |
| 2,964,772 | 12/1960 | Crawford | 15/244.1 |
| 3,008,169 | 11/1961 | Dearling . | |
| 3,179,108 | 4/1965 | Bloch et al. | 132/143.1 |
| 3,337,895 | 8/1967 | Clements . | |
| 3,562,838 | 2/1971 | Burton et al. | 15/143.1 |
| 3,863,654 | 2/1975 | Morane et al. | 132/320 |
| 4,887,994 | 12/1989 | Bedford | 132/317 |
| 5,031,647 | 7/1991 | Seidler | 132/317 |
| 5,077,857 | 1/1992 | Sellers | 15/114 |
| 5,123,431 | 6/1992 | Wilson | 132/320 |
| 5,135,112 | 8/1992 | Kamen et al. | 132/317 |
| 5,230,119 | 7/1993 | Woods et al. | 15/143.1 |
| 5,402,550 | 4/1995 | Lessard | 15/143.1 |
| 5,671,497 | 9/1997 | Abdo | 15/244.1 |

FOREIGN PATENT DOCUMENTS

| | | | |
|---|---|---|---|
| 0 336 641 A2 | 10/1989 | European Pat. Off. . | |
| 441667 | 8/1991 | European Pat. Off. | 132/320 |
| 0 694 266 A1 | 1/1996 | European Pat. Off. . | |
| 209908 | 1/1924 | United Kingdom | 15/114 |
| 433 601 | 8/1935 | United Kingdom . | |

*Primary Examiner*—Gene Mancene
*Assistant Examiner*—Eduardo C. Robert
*Attorney, Agent, or Firm*—Oblon, Spivak, McClelland, Maier & Neustadt, P.C.

[57] ABSTRACT

A sandwich-type product applicator (1) includes a support (2) defining an applicator portion (4) and a gripping portion (6). The support is semi-rigid and the gripping portion is covered, at least in part, by a layer **(16*a*)** of a first soft spongy material. The flexibility of the first material is greater than the flexibility of the support.

20 Claims, 1 Drawing Sheet

PRODUCT APPLICATOR AND PACKAGING UNIT COMPRISING SUCH APPLICATOR

BACKGROUND OF THE INVENTION

1. Field of the Invention

The invention relates to a sandwich-type applicator for a powdery or pasty product. It is intended in particular for the application of a make-up product such as eye shadow, cheek blusher, make-up foundation, eyeliner, a nail-care product, liquid lip rouge, or loose powder.

Applicators for make-up products such as eye shadows or cheek blushers generally comprise an applicator portion which may be either a tuft of bristles (a pencil brush) or a foam end fitting fixed to the gripping portion such as a rigid handle, generally made of plastic.

When the user wishes to make up, she holds the applicator by the rigid handle with her fingers, impregnates the applicator portion with the make-up product and places the impregnated applicator portion into contact with the zone of the skin to be made up (the eyelid or the cheek). Subsequently, the user moves the applicator while keeping the applicator portion in contact with the skin, to spread the make-up product on the skin.

It is known that applicators with a rigid handle, fitted with a foam end fitting, are soft on contact with the skin. However, a rigid handle does not impart a feeling of softness to the user's finger. Moreover, the handle may slip from the fingers during the making up operation, causing the making up to be imprecise. Moreover, if the user presses hard on the skin during the making up operation, for making up the eyelids for example, this results in excessive pressure on the skin, which renders the making up operation unpleasant.

There therefore exists the need for a make-up applicator whose grip is agreeable for the user.

SUMMARY OF THE INVENTION

It is an object of the present invention to remedy the above mentioned drawbacks.

It is a further object of the present invention to provide an applicator making it possible to effect make-up operations with a feeling of softness.

It is yet a further object of the invention to ensure a good grip of the applicator.

It has unexpectedly and surprisingly been discovered that such results can be obtained by making an applicator with a semi-rigid support including at least one soft spongy material.

Although the applicator is recommended for the application of a make-up product, it can be suitable for the application of any other powdery, pasty or liquid product, and in particular for food products, paints and adhesives.

The present invention therefore provides a sandwich-type product applicator comprising a support defining an applicator portion and a gripping portion, wherein the support is semi-rigid and the gripping portion is covered, at least in part, by at least one layer of a first soft spongy material the flexibility of which is, greater than the flexibility of the support.

The first soft material of the gripping portion makes it possible to obtain a feeling of softness at the user's fingers. This softness, associated with the semi-rigidity the of support, gives the user a feeling of softness when the applicator is used for spreading the product.

The applicator portion of the applicator may be a tuft of bristles, a pencil brush, a feather (quill) or even a foam, a sponge or a baize material. Advantageously, the applicator portion may be a portion of the support covered, at least in part, by at least one layer of a second soft spongy material, which makes it possible to obtain an exceedingly soft application of the product on the skin.

In accordance with the invention, the first and the second materials may be identical or different. Thus the softness at the fingers of the gripping portion of the applicator, and of the applicator portion, may be identical or different. Preferably, these materials are identical and are formed of a material chosen from foams of polyurethane, polyester, polyether, polyvinyl chloride or polyethylene.

Advantageously, the first and/or the second spongy material fixed to one side of the applicator may be a leakproof foam with closed cells. This material makes it possible to obtain an applicator having one side impervious to the product. Moreover, at least one of the spongy materials may be flocked or covered with a fabric or a silicone layer, which makes it possible to modify the softness of the spongy material. Moreover, the spongy materials may be impregnated with active cosmetic agents, and in particular with anti-bactericidal agents, fungicides and agents filtering ultraviolet radiation.

Advantageously, the support may have at least two parallel sides, which allows the applicator to be held more easily between the fingers (finger and thumb). Preferably the distance between the two parallel sides of the support is less than the greatest dimension of the support. Thus the small thickness of the support makes it very flexible. This support may be made of cardboard, plastic, leather, or of a foam that is more rigid than the first and second spongy materials. The support may, moreover, have a constriction to increase its flexibility.

The applicator may have any shape. In particular, it may take the form of a strip of uniform width, or one having a thin portion and a wide portion, or even the form of a puff. The wide portion may have, as viewed from above, a polygonal (square) or circular shape. Moreover, as viewed from above, the puff may have a polygonal (square) or circular shape.

Moreover, the applicator may have a median axis parallel to the parallel sides of the support and the applicator portion, and the gripping portion may be symmetrical relative to this median axis.

In accordance with the invention, the first spongy material may be fixed to one of the sides, or to the two sides, of the support. Moreover, the second spongy material may be fixed to one of the sides or to the two parallel sides. Preferably, the first and second materials are fixed to the same side of the support.

Advantageously, the applicator may have on the same side one or several layers of a spongy material that are identical or different, both as regards the gripping portion and the applicator portion. Thus the flexibility of the applicator portion and of the gripping portion may be identical or different. In particular, it is possible to use spongy materials which are incompatible with one another and which cannot be welded directly to one another. In this case, the materials are bonded to the support, and possibly to one another in the case of multilayer materials.

Moreover, the layer or layers of the first and second materials may be joined or separated in a plane parallel to the sides of the support.

Advantageously, the edges of the layers of the first and of the second material are not compressed, or even welded by compression, which makes it possible to preserve the feeling of softness during use of the applicator.

According to a variant, the applicator may have one or several cutouts traversing the support and the first and/or second materials from one side to the other, i.e., through its thickness. Because of the presence of these cutouts, it is possible to vary the surface in contact with the fingers and/or with the skin. This cutout or cutouts may be in the gripping portion and/or the applicator portion. It has the effect of modifying the flexibility of the support of the applicator. In particular, when the cutout is in the gripping portion, the softness of this gripping portion to the user's fingers is increased. When the applicator portion has the cutout, the softness of the application during the application of the product is increased and it is thus possible to obtain a different make-up effect.

Advantageously, the applicator in accordance with the invention may be obtained by cutting out a plate of multilayer materials.

It is another object of the invention to provide a product-packaging unit, in particular for a make-up product, comprising a container provided with a product reservoir and an applicator, wherein the applicator conforms to the sandwich-type applicator described above. When the product is a make-up product, the container may be a compact and the reservoir for the product may be a receptacle containing the make-up product. Advantageously, the compact has a lid and a receptacle that are pivotally mounted and the applicator is sandwiched between the lid and the receptacle, it then being possible for a dish to be accommodated in the receptacle.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
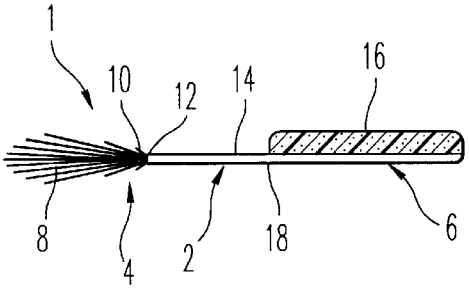
FIG. 1 is a longitudinal section of an applicator in accordance with a first embodiment of the invention.

FIG. 1 shows a sandwich-type make-up applicator, designated by the reference numeral 1 as a whole, which is provided with a semi-rigid strip-shaped support 2 having a longitudinal core and two parallel sides 14, 18. The support 2 may be made of cardboard. The applicator 1 has an applicator portion 4 and a gripping portion 6. The applicator portion has a tuft of bristles 8 held in position with a tight grip in a collar 10 fixed to one end 12 of the support 2. On the upper side 14 of the support 2, the gripping portion 6 has a layer 16 of a soft spongy material which may be a polyurethane foam. The foam layer 16 is bonded to the side 14. The flexibility of the foam 16 is greater than the flexibility of the cardboard support 2. The thickness of the material 16 is here greater than that of the support 2.

When the user wishes to make up, for example her eyelids, she takes the gripping portion 6 between her forefinger and thumb. After having impregnated the applicator portion 4 with the product, she applies it to the eyelid and then spreads the product by displacing the applicator over the eyelid. Since the foam 16 is more flexible than the support 2, the gripping of the applicator imparts a feeling of softness to the user's fingers. Moreover, the making up operation is felt to be very soft because of the slight deformation of the support 2 which occurs during the application, due to the flexibility of the support. This deformation renders the contact of the applicator portion 4 less aggressive to the eyelids.

Figure 2:
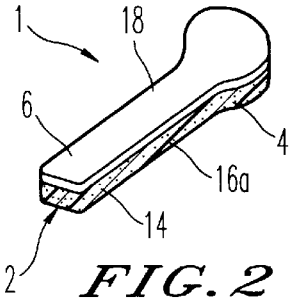
FIG. 2 is a view in elevation of a applicator in accordance with a second embodiment of the invention.

FIG. 2 shows an embodiment which differs from that of FIG. 1 by the nature of the applicator portion. Here the side 14 of the support 2 is completely covered by a layer 16*a* of a neoprene foam. Thus a continuity is obtained between the applicator portion 4 and the gripping portion 6 of the applicator 1. It is possible to decorate the uncovered side 16 of the support 2 by a color or a design.

Figure 3:
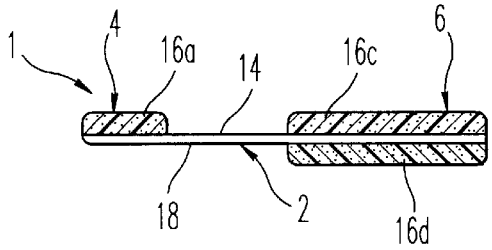
FIG. 3 is a longitudinal section of an applicator in accordance with a third embodiment of the invention.

FIG. 3 shows an embodiment differing from that of FIG. 2, in particular by the number of layers covering the gripping portion. Moreover, the applicator portion 4 has, on the side 14 of the support 2, a layer of a third soft spongy material 16*a*. The support 2 is covered on its side 14 by a layer 16*c* of a first soft spongy material, and on its side 18 by a layer 16*d* of a second soft spongy material different from the material 16*a*. Moreover, the materials 16*a* and 16*c* are not connected.

Figure 4:
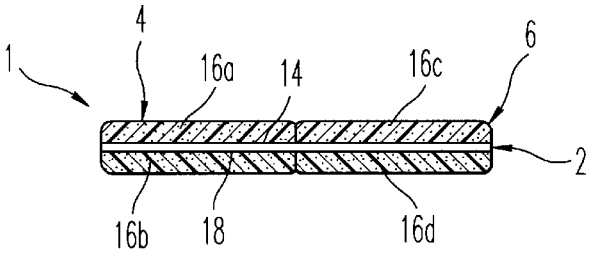
FIG. 4 is a longitudinal section of an applicator in accordance with a fourth embodiment of the invention.

FIG. 4 shows an embodiment differing from that of FIG. 2 in that all the sides of the support 2 are covered by a soft material. The applicator portion 4 is covered on the sides 14, 18 of the support 2 by respective layers 16*a*, 16*b* of a first and a second soft spongy material which are different, and the gripping portion 6 is covered on the sides 14, 18 of the support 2 by respective layers 16*c*, 16*d* of a third and a fourth soft spongy material which differ from each other and from the materials 16*a*, 16*b*.

Figure 5:
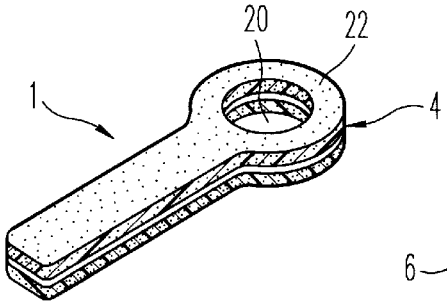
FIGS. 5 to 7 show, in elevation, various shapes of applicators in accordance with the invention.

FIG. 5 shows an applicator similar to that of FIG. 1, wherein a cutout 20 has been cut from one side to the other of the applicator portion 4. This cutout 20 modifies the softness of the applicator portion 4 of the applicator 1. The external surface 22 of the applicator 1 is covered by a flock coating. Moreover, the material of the applicator portion and of the gripping portion 6 are identical and continuous on either side of the support.

Figure 6:
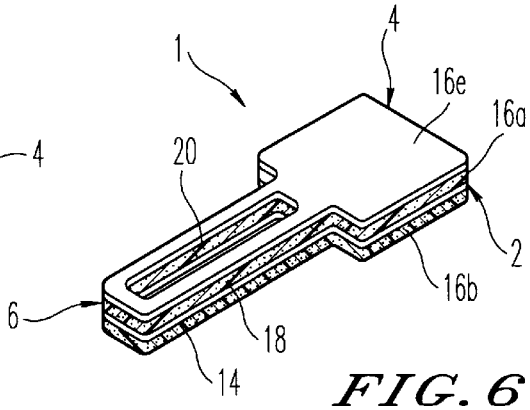

The applicator of FIG. 6 is substantially the same as that of FIG. 5, except that the cutout is in the gripping portion 6 which has the shape of a parallelepiped with a width smaller than that of the strip-shaped applicator portion 4. Over the whole of the sides 14, 18 of the support 2 the applicator 1 has respective layers 16*a*, 16*b* of a first and a second material which differ from one another. The layer 16*a* is completely covered by a layer 16*e* of a textile fabric made, for example, of cotton, so as to modify the softness of the applicator. Moreover, although not shown, the layer 16*b* could be covered by a layer of a soft and lightly abrasive material which can be used to exfoliate the skin or to rub down the surface of a nail before the application of the product with the layer 16*e* of the applicator.

Figure 7:
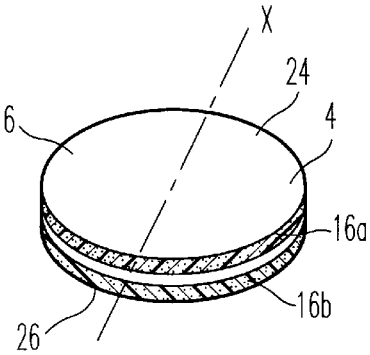

FIG. 7 shows an embodiment differing from that of FIGS. 1 to 6 in that the applicator is disk-shaped. The applicator 1 is, in fact, a puff having sides 24, 26 and a median axis (X) parallel to the sides 24, 26. The applicator portion 4 and the gripping portion 6 are symmetrical relative to the axis (X). Because of the symmetry of the puff, the portion of the puff situated on either side of the median axis may form a gripping portion or an applicator portion, the symmetrically opposite portion then serving as the other of the applicator portion or the gripping portion. It is, moreover, possible for the side 24 of the puff to be used for the application of a make-up product, the other side 26 then having a foam layer 16*b* with closed cells that is impervious to this product.

Figure 8:
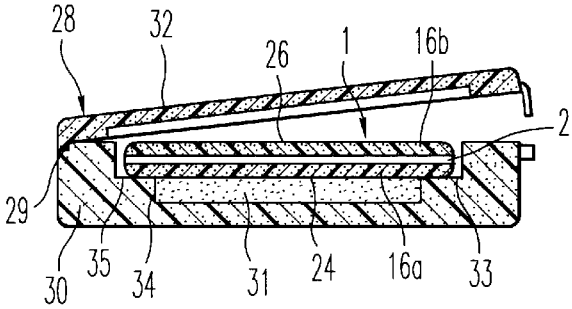
FIG. 8 shows a longitudinal section of a packaging unit in accordance with the invention.

FIG. 8 shows a packaging unit 28 for a make-up product 31 in the form of a compact having a receptacle 30 and a lid 32 which are pivotally connected together by a strip hinge 29. The receptacle 30 has a recess 33 wherein is accommodated a dish 34 containing the make-up product 31. The compact 28 contains the puff 1 of FIG. 7 in the recess 33, surmounting the product. A shoulder 35 of the recess ensures that the puff is held in position. The layer 16*b* of the closed cell foam of the puff ensures the seal between the product and the lid 32.

Obviously, numerous modifications and variations of the present invention are possible in light of the above teachings. It is therefore to be understood that the invention may be practiced otherwise than as specifically described herein.

What is claimed as new and desired to be secured by Letters Patent of the United States is:

1. A sandwich-type product applicator comprising:

a flexible support defining an applicator portion and a gripping portion;

at least one layer of a first soft spongy material and a second soft spongy material covering the gripping portion, the flexibility of said first material being greater than the flexibility of the support; and at least one cutout traversing the support and the first and second materials.

2. An applicator according to claim 1 wherein at least one of said first and second materials is a multilayer material.

3. An applicator according to claim 1 wherein at least one of said first and second materials is flocked.

4. An applicator according to claim 1 wherein at least one of the first and second materials is covered by a fabric.

5. An applicator according to claim 1 wherein at least one of said first and second materials is made of foam.

6. An applicator according to claim 1 wherein the support is strip-shaped.

7. An applicator according to claim 1 in the form of a puff.

8. An applicator according to claim 1 wherein the layers of the first and second materials have edges which are neither compressed nor welded by compression.

9. An applicator according to claim 1 formed as a multilayer body.

10. An applicator according to claim 1 wherein the support has at least two parallel sides.

11. An applicator according to claim 10 having a median axis parallel to said sides, wherein said applicator portion and said gripping portion are symmetrical relative to the median axis.

12. An applicator according to claim 1 wherein said first and second materials are identical.

13. An applicator according to claim 12 wherein the first spongy material is fixed to at least a first side of the support.

14. An applicator according to claim 13 wherein the second spongy material is fixed to said first side of the support.

15. An applicator according to claim 12 wherein said first material is fixed to two parallel sides of the support.

16. An applicator according to claim 12 wherein said second material is fixed to two parallel sides of the support.

17. A product packaging unit comprising:

a container having a product reservoir;

an applicator positionable in said container and comprising a flexible support defining an applicator portion and a gripping portion, and at least one layer of a first soft spongy material and a second soft spongy material covering the gripping portion, the flexibility of said first material being greater than the flexibility of the support; and at least one cutout traversing the support and the first and second materials.

18. A product packaging unit for make-up comprising:

a compact provided with a receptacle containing a make-up product;

an applicator comprising a flexible support defining an applicator portion and a gripping portion, and at least one layer of a first soft spongy material and a second soft spongy material covering the gripping portion, the flexibility of said first material being greater than the flexibility of the support; and at least one cutout traversing the support and the first and second materials.

19. A product packaging unit for make-up according to claim 18, wherein said compact has a lid pivotally connected to the receptacle, said applicator being sandwiched between the lid and the receptacle.

20. A packaging unit according to claim 18 wherein the make-up product is chosen from loose powders, cheek blushers, eye-shadows, eye-liners and nail care products.

* * * * *